US005103132A

United States Patent [19]

Van Der Bolt et al.

[11] Patent Number: 5,103,132

[45] Date of Patent: Apr. 7, 1992

[54] COLOUR DISPLAY TUBE WITH SHADOW MASK LESS SENSITIVE TO MICROPHONICS

[75] Inventors: Antonius J. J. M. Van Der Bolt; Wilhelmus M. M. Van Der Steen; Jan P. Meijer, all of Eindhoven, Netherlands

[73] Assignee: U.S. Philips Corporation, New York, N.Y.

[21] Appl. No.: 619,853

[22] Filed: Nov. 29, 1990

[30] Foreign Application Priority Data

Dec. 6, 1989 [NL] Netherlands ..... 8902997

[51] Int. Cl.[5] ..... H01J 29/07

[52] U.S. Cl. ..... 313/402; 313/404; 313/407

[58] Field of Search ..... 313/402, 404, 407

[56] References Cited

U.S. PATENT DOCUMENTS 4,638,211 1/1987 Fonda ..... 313/407 X
4,678,963 7/1987 Fonda ..... 313/407 X
4,876,477 10/1989 De Deugd et al. ..... 313/404

FOREIGN PATENT DOCUMENTS 2097996 11/1982 United Kingdom .

*Primary Examiner*—Donald J. Yusko
*Assistant Examiner*—Ashok Patel
*Attorney, Agent, or Firm*—John C. Fox

[57] ABSTRACT

A colour picture tube in which a shadow mask is attached to a frame which consists of two short sides and two long sides connected with angular elements. The ends of the short sides of the frame are connected to the angular elements in a way to leave the sides of the frame extending free from the angular elements. The skirt of the shadow mask bears against this free portion. As a result, the shadow mask 10 is less sensitive to vibrations.

6 Claims, 3 Drawing Sheets

COLOUR DISPLAY TUBE WITH SHADOW MASK LESS SENSITIVE TO MICROPHONICS

BACKGROUND OF THE INVENTION

The invention relates to a colour display tube, comprising an envelope with a substantially rectangular display window, a substantially rectangular shadow mask provided with a large number of apertures and a skirt, a substantially rectangular frame, to which the skirt of the shadow mask is attached, and connecting elements attached to the frame.

Such a colour display tube is disclosed in the British Patent Application GB-A-2097996. Displaying a picture in such a colour display tube is achieved by deflecting electron beams, generated in the envelope, over a luminescent display screen deposited on the inner surface of the display window, the electron beams passing through the shadow mask.

In practice it has been found that the shadow mask can make unwanted movements due to vibrations and shocks (sensitivity to microphonics). These movements can disadvantageously influence the quality of a picture to be displayed.

OBJECTS AND SUMMARY OF THE INVENTION

The invention has for one of its object to provide a colour display tube in which the shadow mask is less sensitive to microphonics and the picture quality is improved.

According to the invention, a colour display tube of the type defined in the opening paragraph, is characterized in that at least one side of the frame has in a cross-sectional view in a direction along the side, a portion which is attached to a connecting element, and a portion which extends free from the connecting elements, a portion of the skirt of the shadow mask bearing against this free portion.

Since a portion of the frame is free from the connecting element, this portion can during the occurrence of vibrations make a movement deviating from the movement of the portion attached to the connecting element. When the portion of the skirt bears against this free portion i.e. the said portions are not fixed to one another, then the skirt can slide over the free detached, portion, thereby causing friction. As a result of this friction, the frame functions as a vibration damper between the connecting element and the shadow mask. This renders the shadow mask sufficiently insensitive to vibrations.

A preferred embodiment of a colour display tube according to the invention, in which the frame is mounted via the connecting elements in the corners of the display window, is characterized, in that each of the ends of two facing short sides of the frame has in a cross-sectional view in a direction along the side a portion, which is attached to the relevant connecting element, and a portion which extends free from the connecting element, a portion of the skirt of the shadow mask bearing against this free portion. Even if the colour display tube is used in an environment where considerable vibrations and shocks occur, it appears in practice that a desired vibration damping is achieved.

A further preferred embodiment of a colour display tube according to the invention, in which vibration damping is obtained in a simple manner, is characterized, in that at least one end of one of the said sides of the frame has a stepped profile. This stepped profile renders it possible for the free portion of the frame to surround the connecting element at least partly, as a result of which the whole structure can be of a compact form.

A further preferred embodiment of a colour display tube according to the invention, is characterized in that each of the ends of two facing short sides of the frame, has in a cross-sectional view in a direction along the short side a portion which is attached to the relevant connecting element and a portion which extends free from the connecting element, a portion of the skirt of the shadow mask bearing against the free portion and in that each of the ends of two facing long sides of the frame has, in a cross-sectional view in a direction along the long side a portion which is attached to the relevant connecting element and a portion which is free from the connecting element, a portion of the skirt of the shadow mask being attached to this free portion. This structure appears to be extremely suitable for damping vibrations in the shadow mask, in combination with the mutual interconnection of the frame, connecting elements and the shadow mask, while maintaining a mechanically stable connection between the shadow mask and the frame.

BRIEF DESCRIPTION OF THE INVENTION

The invention will now be described in greater detail by way of example with reference to the accompanying drawing, in which FIG. 1 is a schematic longitudinal cross-sectional view of a colour display tube according to the invention;

DESCRIPTION OF THE PREFERRED EMBODIMENTS

Figure 1:
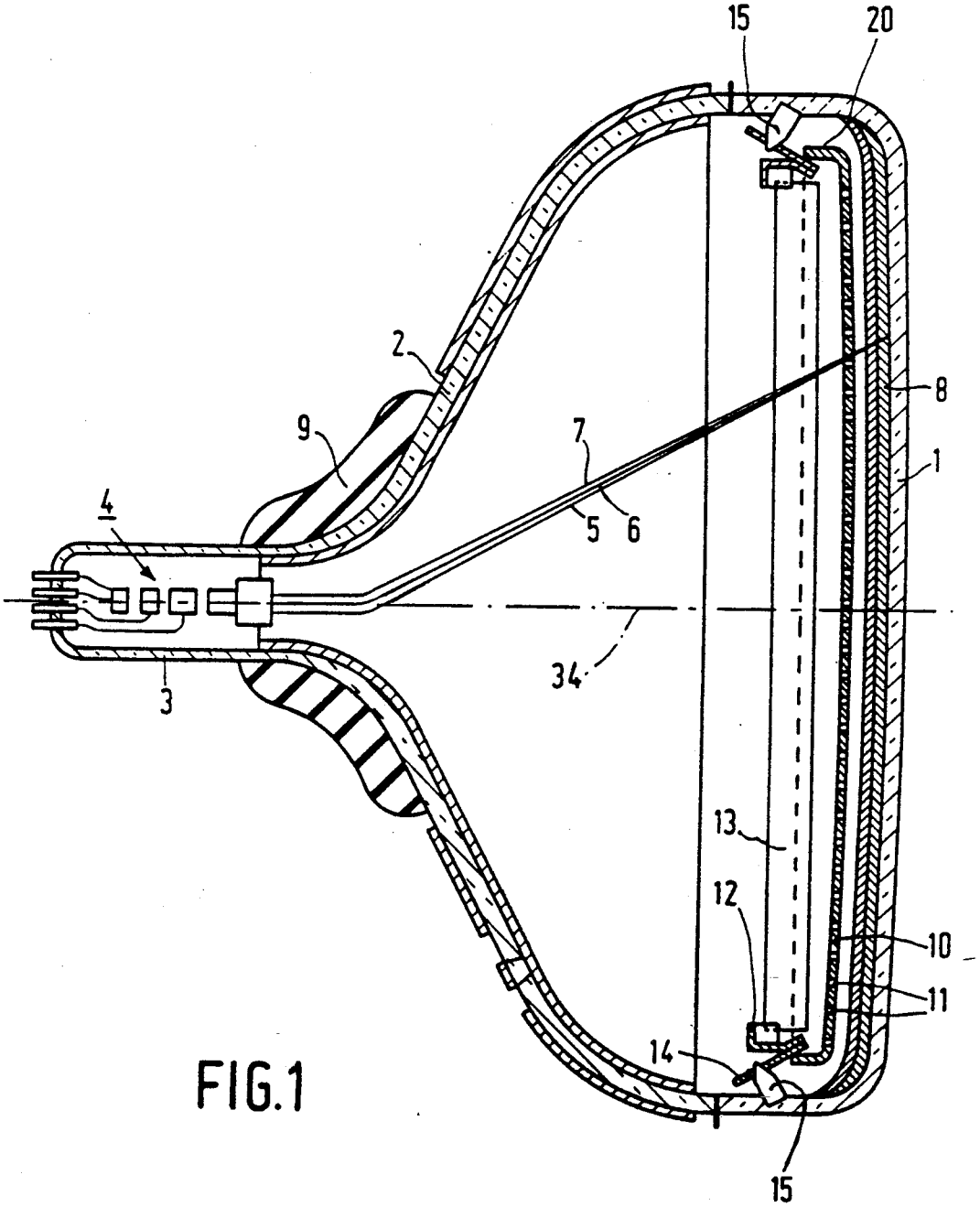

The colour display tube, shown schematically in a longitudinal cross-sectional view in FIG. 1, comprises an envelope, having a substantially rectangular display window 1, a cone-like envelope portion 2 and a neck portion 3. In the neck portion 3, an electrode system 4 for generating, for example, three electron beams 5, 6 and 7 is located. The electron beams are generated in one plane (in this case the plane of the drawing), and are directed to a luminescent display screen 8 which is deposited on the inside of the display window 1. The display screen 8 consists, for example, of a large number of phosphor elements luminescing in red, green and blue. On their way to the display screen 8, the electron beams 5, 6 and 7 are deflected by means of a number of deflection coils 9, arranged coaxially around the longitudinal axis 34 of the colour display tube. Said electron beams pass through a shadow mask 10, which comprises a thin metal sheet, having a large number of apertures 11 and an upright edge 20 (the skirt of the shadow mask). The three electron beams 5, 6 and 7 pass through the apertures 11 at a small angle with respect to each other, and consequently each beam impinges on only one phosphor element of one colour. The shadow mask 10 is attached to a frame 13, which is suspended from pins 15 in the display window 1 by means of suspension elements 14.

Figure 2:
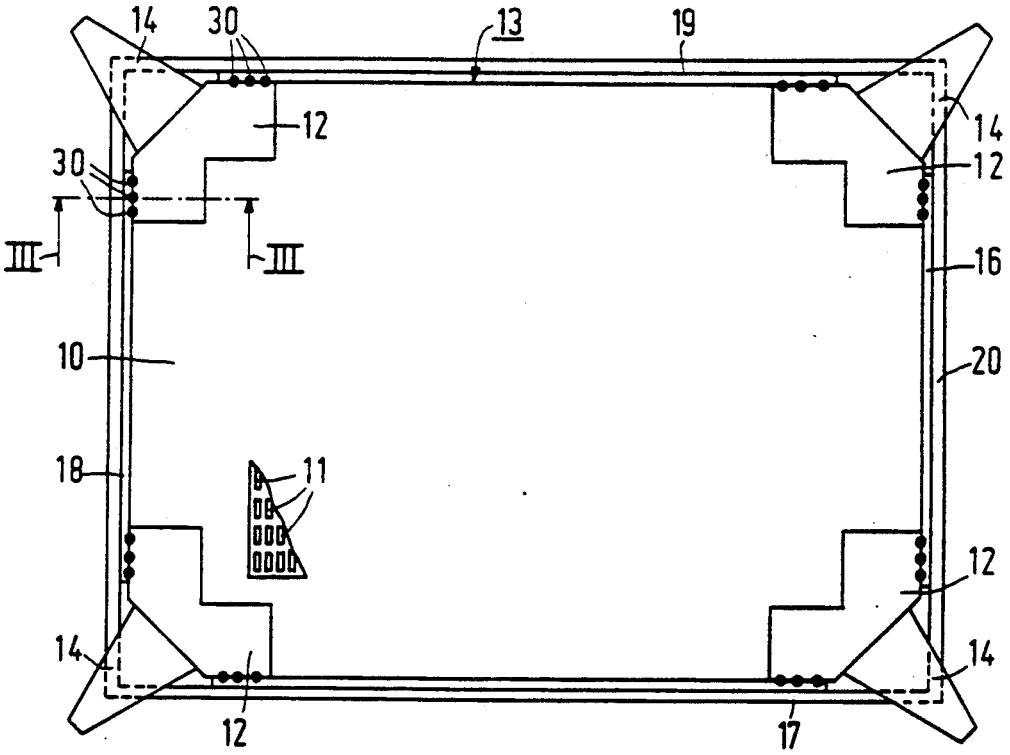
FIG. 2 is a schematic front view of a shadow mask attached to a frame.

As shown schematically in FIG. 2, the frame 13 consists, for example, of four thin-walled separate portions 16, 17, 18 and 19, which are interconnected by means of connecting elements, in this case angular elements 12. The portions 16 and 18 are shorter than the portions 17 and 19. Each portion 16, 17, 18 and 19 has its end attached to an angular element, for example by means of spot welding, as depicted by the dots 30. This provides a mechanically stable frame 13. The skirt 20 of the shadow mask 10 is attached to the separate portions, for example by means of spot welding. To avoid differences of expansion between the shadow mask 10 and the frame 13, they are in this case made of the same material and are of equal thickness. In the illustrated arrangement a flexible suspension element 14 is attached to each angular element 12 and mounted a pin 15 in a corner of the window. However, the invention is not limited to this mode of suspending the shadow mask in the corners of the display window, but applies, for example, also to a suspension arrangement in which the suspension elements are halfway along the sides of the display window. Furthermore, it is also possible in a further embodiment of a colour display tube according to the invention to manufacture the frame as one integral whole.

Figure 3:
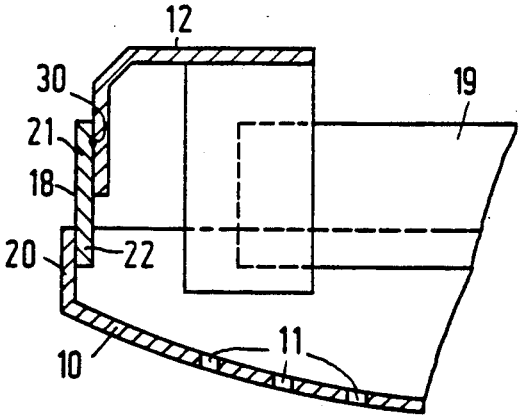
FIG. 3 is a schematic cross-sectional view of a portion of an embodiment of a colour display tube according to the invention.

FIG. 3 shows schematically in a cross-sectional view a portion of an embodiment of a colour display tube according to the invention, taken on the line III—III of FIG. 2.

An upper portion 21 of one end of the short side 18 of the frame, in this case in the form of a flat strip, bears against the angular element 12 in a cross-sectional view, seen in a direction along the side, and is attached thereto by the spot welds 30. A portion of the skirt 20 of the shadow mask 10 bears against the projecting portion 22, extending free from the angular element 12. At the occurrence of vibrations, the free portion 22 can make a movement which deviates from that of the angular element 12. The portion of the skirt 20, which bears on the free portion 22, can slide over this free portion.

By virtue thereof, damping of vibrations in the shadow mask 10, is obtained, so that the frame functions as a vibration damper.

With known tubes, if vibrations and shocks occur during the display of a picture, then undesirable movements of the shadow mask can occur, causing of the apertures of the shadow mask to be shifted with respect to the phosphor elements of the display screen and leading to unwanted colour errors.

In the display tube of the invention, however, with the frame functioning as a vibration damper, any undesirable effects upon the occurrence of vibrations and shocks to the tube are avoided at least to a large extent. Even in an environment in which severe vibrations and many shocks occur, a very effective vibration damping is achieved, more specifically if both ends of the two facing short sides 16 and 18 of the frame are attached to the angular elements in a similar manner and a portion of the skirt 20 of the shadow mask 10 bears on the free portions of the frame.

Figure 4:
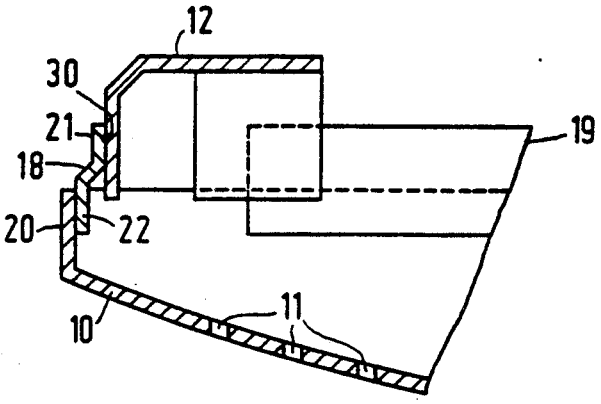
FIG. 4 is a schematic cross-sectional view of a portion of an alternative embodiment of a colour display tube according to the invention.

FIG. 4 shows schematically in a cross-sectional view a portion of an alternative embodiment of a colour display tube according to the invention. The sides of the frame are here provided with a stepped profile, as shown for side 18. In this embodiment it is possible for the free portion 22 to surround the angular element at least partly. The assembly of the frame and the shadow mask can therefore be structured more compactly, which inter alia improves the ease of handling of the assembly during the manufacture of the colour display tube.

Figure 5:
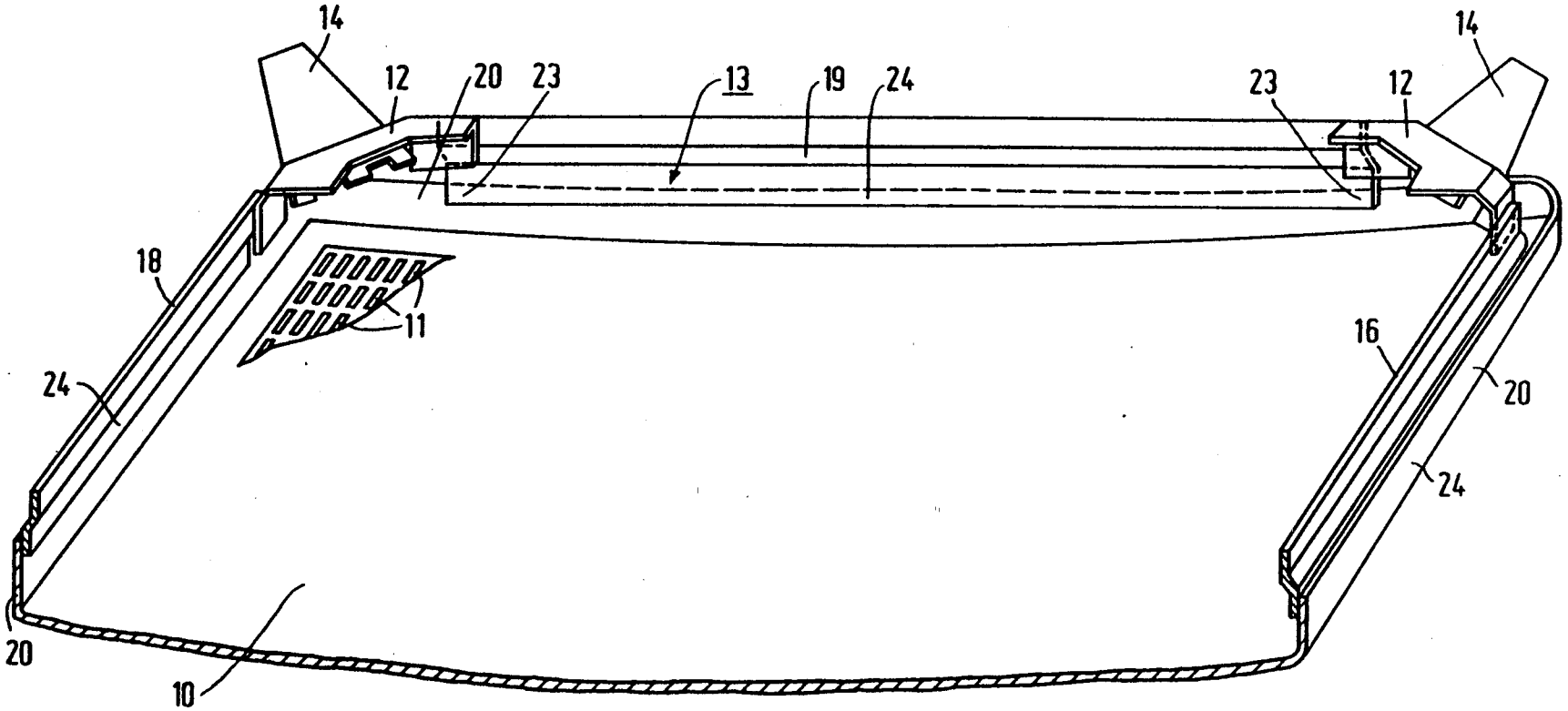
FIG. 5 is a schematic perspective view of a portion of a shadow mask attached to a frame in a colour display tube according to the invention.

FIG. 5 is a schematic perspective view of a portion of a shadow mask 10 attached to a frame 13 in a colour display tube according to the invention. Both the two short sides 16 and 18, and the two long sides (of which only side 19 is shown) of the frame 13 have a stepped profile. The skirt 20 of the shadow mask 10 bears against the free portions 22 of the ends of the short sides 16 and 18. The skirt of the shadow mask is attached to the free portions of the ends of the long sides, for example, by means of spot welds 23. Halfway along the long as well as the short sides of the frame the skirt 20 is attached to these sides by means of spot welds 24. This structure, in relationship with the interconnection of the frame, the angular elements and the shadow mask, appears to be extremely suitable for damping vibrations in the shadow mask, while maintaining a mechanically stable interconnection between the portions.

We claim:

1. A colour display tube, comprising an envelope with a substantially rectangular display window, a substantially rectangular shadow mask provided with a large number of apertures and a skirt, a substantially rectangular frame to which the skirt of the shadow mask is attached, and connecting elements attached to the frame, characterized in that in a cross-sectional view in a direction along the side, at least one side of the frame has at least one region containing a portion which is attached to a connecting element, and a portion which extends free from the connecting element, a portion of the skirt of the shadow mask bearing against this free portion.

2. A colour display tube as claimed in claim 1, in which the frame is mounted via the connecting elements in the corners of the display window, characterized in that the frame comprises two facing long elements, two facing short elements, and four connecting elements.

3. A colour display tube as claimed in claim 1, characterized in that at least one end of one of the sides of the frame has a stepped profile.

4. A colour display tube as claimed in claim 2, characterized in that each of the ends of the two facing long sides of the frame has, in a cross-sectional view in a direction along the long side, a region containing a portion which is attached to its corresponding connecting element and a portion which extends free from the corresponding connecting element, to which a portion of the skirt of the shadow mask is attached.

5. A colour display tube as claimed in claim 2, characterized in that at least one end of one of the sides of the frame has a stepped profile.

6. A colour display tube as claimed in claim 3, characterized in that each of the ends of the two facing long sides of the frame has, in a cross-sectional view in a direction along the long side, a region containing a portion which is attached to its corresponding connecting element and a portion which extends free from the corresponding connecting element, to which a portion of the skirt of the shadow mask is attached.

* * * * *